US010061336B1

(12) United States Patent
Shor

(10) Patent No.: US 10,061,336 B1
(45) Date of Patent: Aug. 28, 2018

(54) SWITCH CAPACITOR IN BANDGAP VOLTAGE REFERENCE (BGREF)

(71) Applicant: Bar Ilan University, Ramat Gan (IL)

(72) Inventor: Joseph Shor, Tel Mond (IL)

(73) Assignee: Birad—Research & Development Company Ltd., Bar Ilan University, Ramat Gan (IL)

( * ) Notice: Subject to any disclaimer, the term of this patent is extended or adjusted under 35 U.S.C. 154(b) by 0 days.

(21) Appl. No.: 15/796,807

(22) Filed: Oct. 29, 2017

(51) Int. Cl.
*G05F 1/59* (2006.01)

(52) U.S. Cl.
CPC ..... *G05F 1/59* (2013.01)

(58) Field of Classification Search
CPC ..... G05F 3/30; G05F 3/08; H03F 3/45183; H03F 2203/45674; H03K 3/0315; H03K 3/005
USPC ..... 323/312–316; 327/512, 513, 539–541, 327/543, 554, 131–140, 155
See application file for complete search history.

(56) References Cited

U.S. PATENT DOCUMENTS 5,416,446 A * 5/1995 Holler, Jr. ..... H03K 3/0315 327/114
5,796,313 A * 8/1998 Eitan ..... H03K 3/0315 326/27
6,650,594 B1 * 11/2003 Lee ..... G11C 5/147 365/194
7,317,333 B1 * 1/2008 Zhou ..... H03K 19/0013 326/80
7,982,526 B2 * 7/2011 Lee ..... H03F 1/0261 327/337
9,093,998 B2 * 7/2015 Kinyua ..... H03K 4/50

* cited by examiner

*Primary Examiner* — Rajnikant Patel
(74) *Attorney, Agent, or Firm* — Dekel Patent Ltd.; David Klein

(57) ABSTRACT

A bandgap reference (BGREF) circuit includes at least one switch capacitor impedance element including a capacitor coupled with switches that receive a reference frequency. The at least one switch capacitor element is coupled with at least one diode. The BGREF circuit is operative to create a voltage reference.

18 Claims, 6 Drawing Sheets

SWITCH CAPACITOR IN BANDGAP VOLTAGE REFERENCE (BGREF)

FIELD OF THE INVENTION

The present invention relates generally to voltage references in transistor circuitry, and particularly to the use of switch capacitors in BGREF circuitry.

BACKGROUND OF THE INVENTION

With advances in Internet of Thing (IoT) applications and the expansion of mobile devices, energy consumption has become a primary focus of attention in integrated circuits design. These mobile battery operated devices need to operate for extended periods without recharging and therefore requiring ultra-low energy consumption. Many IoT devices require operation in a wide range of frequencies that are dynamically defined by the application. Low voltage operation in the "near-threshold" region has been shown to be the ideal way to dramatically reduce energy dissipation, still achieving reasonable performance. However, an aggressive scaling of supply voltage results in performance degradation and a much higher sensitivity to process variations and temperature fluctuations.

In addition to the reduction in supply voltage, many of the circuits are duty cycled, and turned off during sleep states. However, there are several types of circuits which need to be "always-on" and operate during standby mode. Among these circuits are real-time-clocks (RTC) and power management circuits, such as low drop out regulators (LDO) and DC-to-DC converters. All of these always-on elements require analog voltage and current references. To meet these requirements, there has been significant recent interest in ultra-low power references.

One such reference known in the prior art is the so-called 2T (two terminal) transistor-based voltage reference, which uses two MOSFET transistors sized such that the temperature coefficients of their threshold voltages (Vth) cancel out, thereby yielding a voltage reference which is temperature independent. Another 2T version uses native zero threshold devices which can produce a reference voltage independent of Vdd with only two transistors. Although the 2T references are very attractive due to their simplicity and ultra-low power (pW range), they have not yet found acceptance in most IOT systems. This is because the temperature coefficient of Vth is not necessarily guaranteed by the process, especially in advanced nodes. In general the use of the temperature dependence of Vth in MOS devices is not considered reliable in real products, since it can change over the course of the product lifetime, due to speed up of the process.

Many computer systems utilize reference voltages produced by the parasitic Bipolar Junction Transistor (BJT), a.k.a. diode based references. The most common of these is shown in FIG. 1 which is a sub-bandgap reference. To first order, the current and voltage across the BJT are as follows:

$$I_C = I_S \exp\left(\frac{qV_{be}}{KT}\right) \text{ and } V_{BE} = V_{g00} - \lambda T \quad [1]$$

where $I_c$ is the collector current, $V_{be}$ is the base-emitter voltage, $V_{g00}$ is the extrapolated $V_{be}$ at 0K, K=Boltzmann constant, q=electron charge, λ is its linear temperature coefficient and T is the absolute temperature. Using equation 1, the CTAT (complimentary to absolute temperature) and PTAT (proportional to absolute temperature) terms can be calculated for the circuit in FIG. 1 to be:

$$V_{ref} = R3\left[\frac{KT}{q * R1}\ln(N) + \frac{Vbe}{R2}\right] \quad [2]$$

The utility of this circuit is that both the voltage and temperature coefficient of Vref can be trimmed by digitally adjusting R3 and R2* respectively. Note that the terms PN diode and BJT are used interchangeably throughout the specification and claims. Essentially, the PN Junction Diode is the parasitic PNP BJT in the CMOS process whose base and collector are both connected to Vss (or ground).

FIG. 2 shows a prior-art switched-capacitor BGREF (bandgap voltage reference) circuit which consumes only 32 nW and operates at 0.5V. The two $V_{be}$ terms are generated by a charge pump circuit, while the delta-$V_{be}$ terms are derived using a switch capacitor addition. It is important to note that in the prior art, the switch capacitor circuits are only used to perform mathematical functions by summing up the charge in the capacitor. The Vbe and delta-Vbe voltage can be summed by the switch-cap network.

One of the limitations and disadvantages of prior art nW BGREF's is very large area, since the low currents necessitate the use of very large resistors in order to generate a significant voltage across them. Another disadvantage is that due to the low currents, the wakeup times of these references can be in the milli-second range.

SUMMARY OF THE INVENTION

The present invention seeks to provide a novel use of switch capacitors in BGREF circuitry.

Since analog circuits do not scale very well as technology advances, it is important to develop new architectures which can enable the analog portions to shrink. In addition, the IoT space requires integrated circuits which can operate at different power/performance levels and which are also low cost. The present invention provides novel voltage references which have low area/cost, ultra-low-current and are configurable in terms of their power. The power in the circuit can be easily adjusted over a large range to provide fast wakeup and higher drive currents when needed, and lower current operation for the "always-on" ultra-low power states. The novel circuit concepts can be optimized for the emerging IoT market.

BRIEF DESCRIPTION OF THE DRAWINGS

The present invention will be understood and appreciated more fully from the following detailed description taken in conjunction with the drawings in which:

FIGS. 7A-7D are graphical illustrations of simulations of the BGREF circuit of FIG. 6 for VCC=1.2V, wherein FIG. 7A shows a low power mode in several corners, FIG. 7B shows the power consumption at these corners, FIG. 7C shows the Vref voltage at different switching frequencies, and the power consumption at these frequencies is shown in FIG. 7D for the typical corner.

DETAILED DESCRIPTION OF EMBODIMENTS

In an embodiment of the present invention, the BGREF includes a switched capacitor (also referred to as switch-cap) circuit.

The impedance Z of a switch-capacitor can be expressed as $$Z = \frac{1}{sC}.$$

where C is the capacitance and s is the frequency. As opposed to resistors, a high impedance switch-cap requires little area, thereby providing a much more compact solution as opposed to the prior art circuitry that uses resistors, which are very large devices in advanced CMOS processes.

The impedance of the switch-cap can be controlled by the frequency (of the switch), and is thus adjustable.

Figure 3:
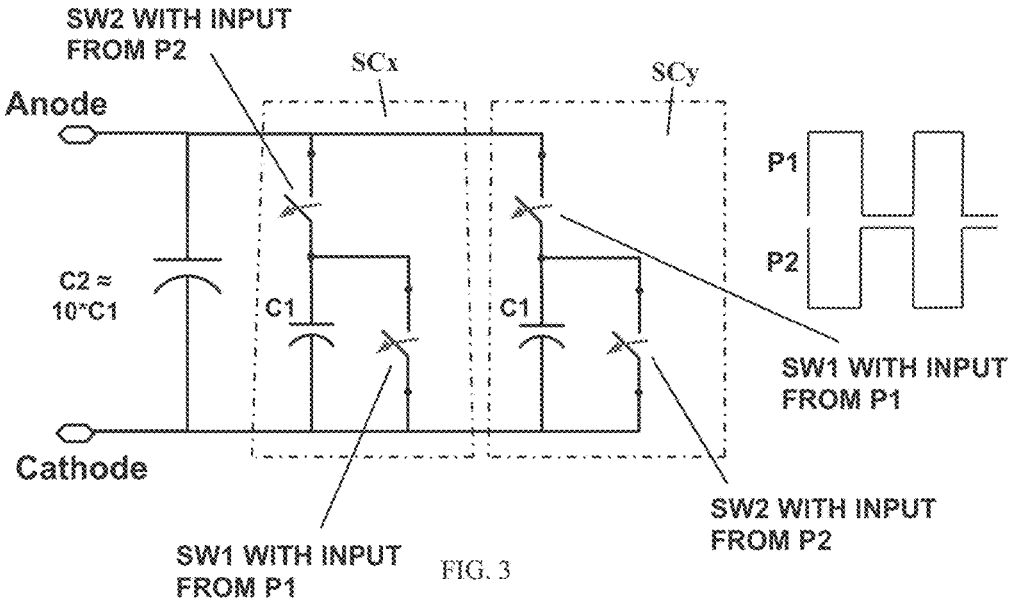
FIG. 3 is a simplified circuit diagram of a switch-cap circuit, in accordance with a non-limiting embodiment of the present invention, which is an impedance element that can be used to implement functionality of a resistor.

Reference is made to FIG. 3, which illustrates a switch-cap circuit, in accordance with an embodiment of the present invention, which is an impedance element that can be used to implement functionality of a resistor.

The non-limiting circuitry of FIG. 3 is now described. In general, throughout the specification and claims, the term "connected" means a direct electrical connection between the things that are connected, without any intermediary devices. The term "coupled" means either a direct electrical connection between the things that are connected or an indirect connection through one or more passive or active intermediary devices. The term "circuit" or "circuitry" means one or more passive and/or active components that are arranged to cooperate with one another to provide a desired function. The term "signal" means at least one current signal, voltage signal or data/clock signal. The meaning of "a," "an," and "the" include plural references. The meaning of "in" includes "in" and "on." For purposes of the embodiments, the transistors are metal oxide semiconductor (MOS) transistors, which include drain, source, gate, and bulk terminals, but the transistors may include any device implementing transistor functionality, such as without limitation, bi-polar junction transistors—BJT PNP/NPN, BiCMOS, CMOS, eFET, etc.

A capacitor C2 (fixed decoupling capacitor C2) is coupled at one side to an anode and at the other side to a cathode. Two switch capacitor elements SCx and SCy (also referred to as switch capacitor impedance elements), each switch capacitor element including a capacitor C1 coupled with overlapping switches SW1 and SW2, which receive an input frequency from clocks P1 and P2, are each coupled between the anode and cathode in parallel to C2. In SCx, clock P2 is coupled between the anode side of C1 and the anode and the other clock P1 is coupled to the cathode and to the anode side of C1. In SCy, clock P1 is coupled between the anode side of C1 and the anode and the other clock P2 is coupled to the cathode and to the anode side of C1.

Accordingly, there are two non-overlapping switches SW1 and SW2 with frequency inputs from clocks P1 and P2 which are placed in anti-phase over two switched capacitors C1 (also referred to as flying capacitors C1). The capacitors C1 may be, without limitation, metal finger capacitors (MFC), e.g., with a capacitance density of 2 ff/$\mu m^2$. The fixed decoupling capacitor C2 may be, without limitation, a hybrid gate and metal capacitor, e.g., with a capacitance of 8-10 ff/$\mu m^2$. C2 is placed there to reduce the ripple caused by the switching action. Note that in FIG. 3, SCx and SCy are each complete switch-capacitor elements. They are placed in anti-phase to reduce the overall ripple in the anode voltage. The switch capacitor element used in the embodiments of the invention may refer to either a single element, such as SCx or SCy of FIG. 3, or to the composite of two anti-parallel elements, which is SCx and SCy and C2 of FIG. 3.

Figure 4:
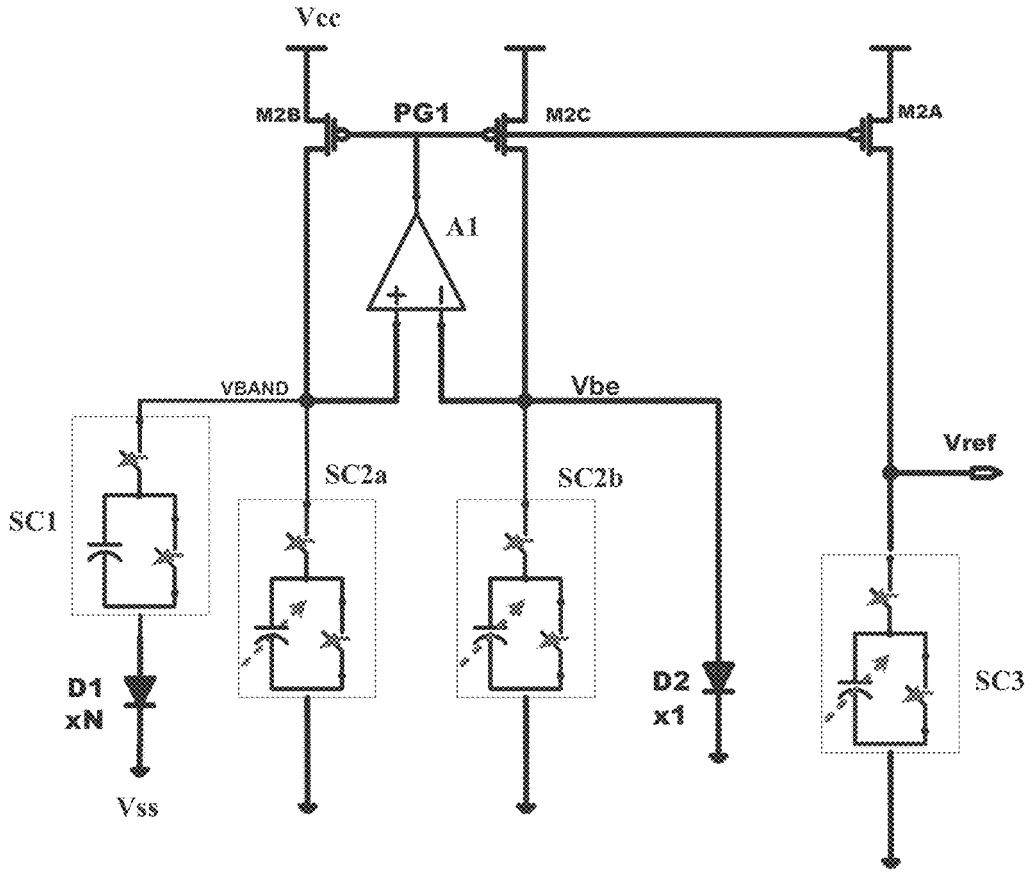
FIG. 4 is a simplified circuit diagram of a BGREF circuit using the switch-cap circuits of FIG. 3, in accordance with a non-limiting embodiment of the invention.

Reference is now made to FIG. 4, which illustrates BGREF circuitry in accordance with an embodiment of the invention, incorporating the switch capacitor circuits of FIG. 3.

A source of PMOS transistor M2B is coupled to a voltage source (Vcc), its drain is coupled to node Vband and its gate is coupled to node PG1. Node PG1 is coupled to the output of an amplifier A1, whose positive input is coupled to Vband and whose negative input is coupled to node Vbe. A source of PMOS transistor M2C is coupled to a voltage source (Vcc), its drain is coupled to node Vbe and its gate is coupled to node PG1.

A switch capacitor element SC1 is coupled at a first terminal (such as, but not necessarily, its anode side) to Vband and at a second terminal (such as, but not necessarily, its cathode side) to a first terminal (such as, but not necessarily, an anode) of a diode D1. The second terminal (such as, but not necessarily, the cathode) of diode D1 is coupled to a negative voltage supply (Vss). A switch capacitor element SC2*a* is coupled at a first terminal (such as, but not necessarily, its anode side) to Vband and at a second terminal (such as, but not necessarily, its cathode side) to a negative voltage supply (Vss). A switch capacitor element SC2*b* is coupled at a first terminal (such as, but not necessarily, its anode side) to Vbe and at a second terminal (such as, but not necessarily, its cathode side) to a negative voltage supply (Vss). A first terminal (such as, but not necessarily, an anode) of a diode D2 is coupled to node Vbe and a second terminal (such as, but not necessarily, its cathode) is coupled to a negative voltage supply (Vss). The area ratio of the two diodes is N, which can be, for example, 8 without limitation.

Note that the diode in a more general sense can be any "diode element" which has an electrical behavior similar to a diode. An example of this would be a transistor whose gate is connected to its drain—this type of connection is referred to as a diode-connected device to those skilled in the art. In the case of an NMOS, the gate-drain connection would be the anode, while its source would be the cathode and this would behave like a PN junction diode. In the case of a PMOS, a similar connection would be true; the gate would be connected to the drain, and the gate-drain connection would be the cathode, while the source would be the anode.

Thus when we refer to a diode element we mean the generalized definition including a PN junction diode (or parasitic BJT) or the MOS diode-connected devices, and the term "diode" in the specification and claims encompasses such diode elements as well.

A source of PMOS transistor M2A is coupled to a voltage source (Vcc), its drain is coupled to node Vref and its gate is coupled to the gate of M2C. A switch capacitor element SC3 is coupled at its anode side to Vref and at its cathode side to a negative voltage supply (Vss).

Figure 1:
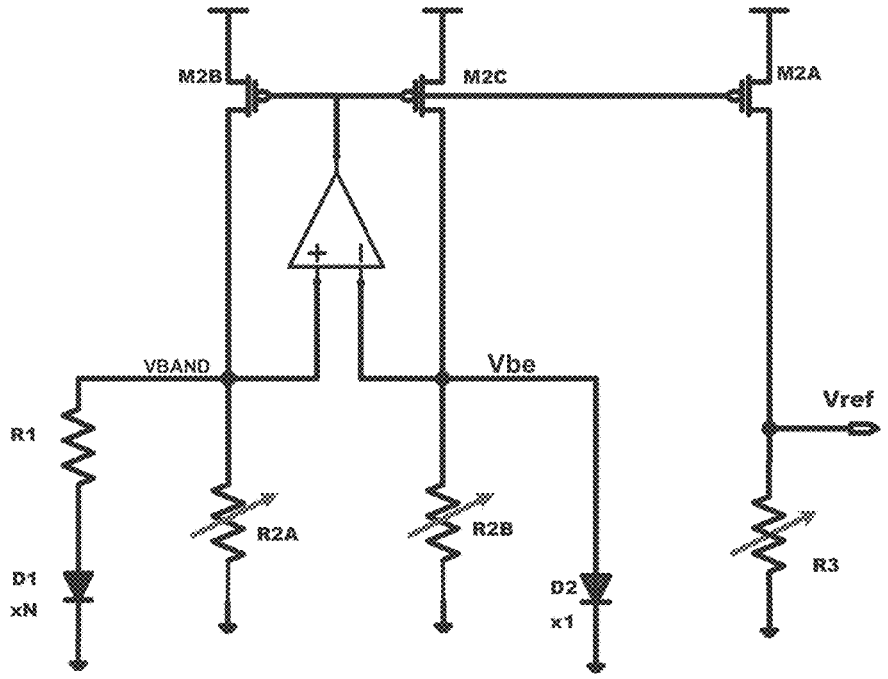
FIG. 1 PRIOR ART
FIG. 1 is a circuit diagram of a prior art BGREF circuit that uses large area resistors.
Figure 2:
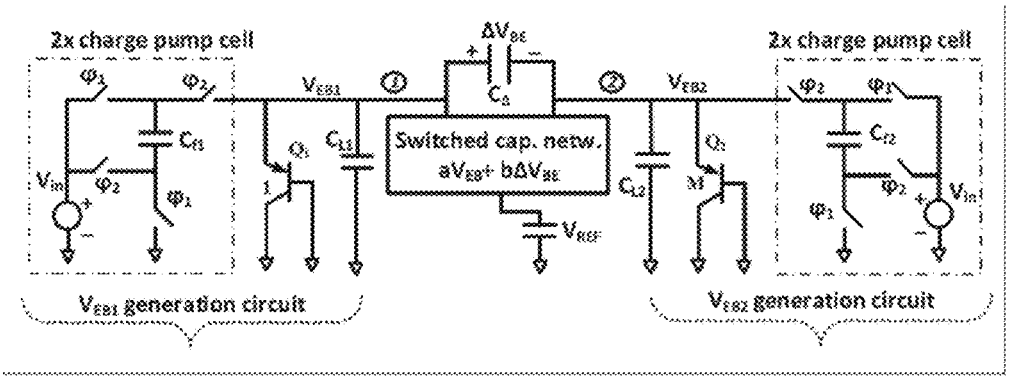
FIG. 2 PRIOR ART
FIG. 2 is a circuit diagram of a prior-art switched-capacitor BGREF circuit, in which the switch capacitor circuits are only used to perform mathematical functions by summing up the charge in the capacitor.

Accordingly, the resistors of the prior art circuitry of FIG. 1 have been replaced with switch capacitor elements of FIG. 3, thereby creating a nW BGREF at minimal size. For example, without limitation, the size of the BGREF circuit using this method can be <6000 $\mu m^2$ with power ~3-5 nW. As mentioned before, the switch-cap is used as an impedance element, which is different from the prior-art switch-cap BGREF of FIG. 2, which uses switched-capacitors in an entirely different way, namely to perform mathematical functions by summing up the charge on the capacitor.

It is possible to construct the BGREF circuit with one switch capacitor element and one diode; however, the preferred embodiment has a plurality of switch capacitors and diodes.

In the embodiment of FIG. 4, the voltages at Vbe and Vband are made equal by the feedback circuit comprised of the amplifier A1 and current sources. Vband is coupled to a first input of the A1, which may be the positive input and Vbe is coupled to the second input of A1, which may be the negative input. Diode D1 is a multiple of diode D2 and since the currents are equal the current density in D2 is a multiple of D1. Note that the anode of D1 (the P of the PN junction) is connected to switched-capacitor impedance element SC1 while its cathode (N of the PN junction) is connected to the negative supply, Vss. Similarly the anode (P) of D2 is connected to Vbe, while its cathode (N) is connected to Vss. The equation for the reference voltage Vref of this circuit can be expressed as:

$$V_{ref} = \frac{1}{SC3}[V_T * SC_1 \ln(N) + SC_2 * Vbe] \tag{3}$$

wherein $V_T$=voltage at a certain absolute temperature T
N=the ratio between the two diodes
$SC_i$=capacitance of the ith switch capacitor
Vbe=base-emitter voltage
The current in the output stage can be expressed as $$I_{ref}=V_{ref}*sSC3=s[V_T*SC_1 \ln(N)+SC_2*Vbe] \tag{4}$$

Similarly, the currents in all of the PMOS current sources can be scaled versions of this and are thus highly dependent on the switching frequency and the capacitance values, thereby providing an additional degree of configurability. The voltage can be calibrated by trimming SC3, and the temperature coefficient can be calibrated by trimming SC2(*a* or *b*). Since a switch is placed in series with each capacitor element, the trim works by making the switch conducting or non-conducting, such that the capacitance connected to the switch may or may not be connected to the active node of the circuit. Thus the values of C1, C2 and C3 can be controlled digitally by activating these switches and the Vbe, Vref and delta-Vbe terms can each be trimmed independently.

Figure 5:
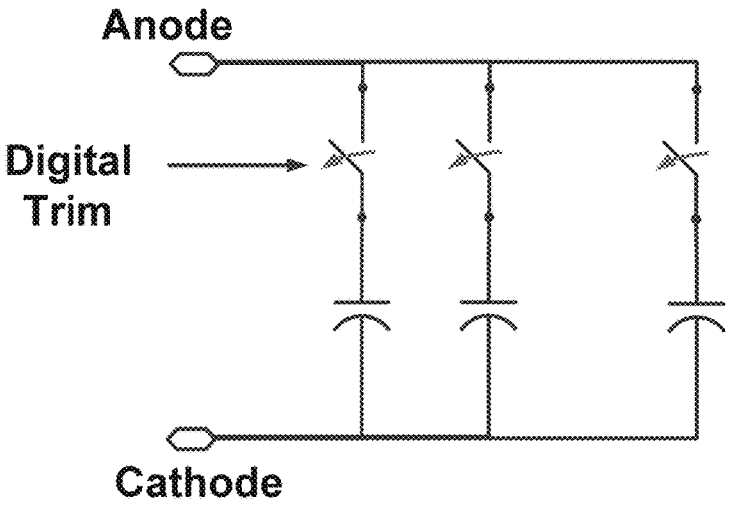
FIG. 5 is a simplified circuit diagram of a (binary) capacitor bank for use as the capacitors in FIG. 4, in accordance with a non-limiting embodiment of the present invention.

One or all of the capacitors in FIG. 4 may be replaced with a capacitor bank (e.g., binary capacitor bank), as shown in FIG. 5 to enable calibration. As seen in FIG. 5, the capacitor bank includes 1–N circuit elements coupled in parallel between the anode and the cathode, wherein the circuit element is a capacitor with one side coupled to the cathode and the other side coupled to a clock which is coupled to the anode.

The bias for the amplifier in FIG. 4 may be taken from the PMOS current sources M2* (that is, M2A or M2B). The circuit can be started up by pulling down node PG1 with a digital pulse. The temperature coefficient trim (SC2 *a* or *b*) can be used to rectify the PTAT non-linearity at ultra-low currents; reversed biased diode methods may also be used to achieve this.

Figure 6:
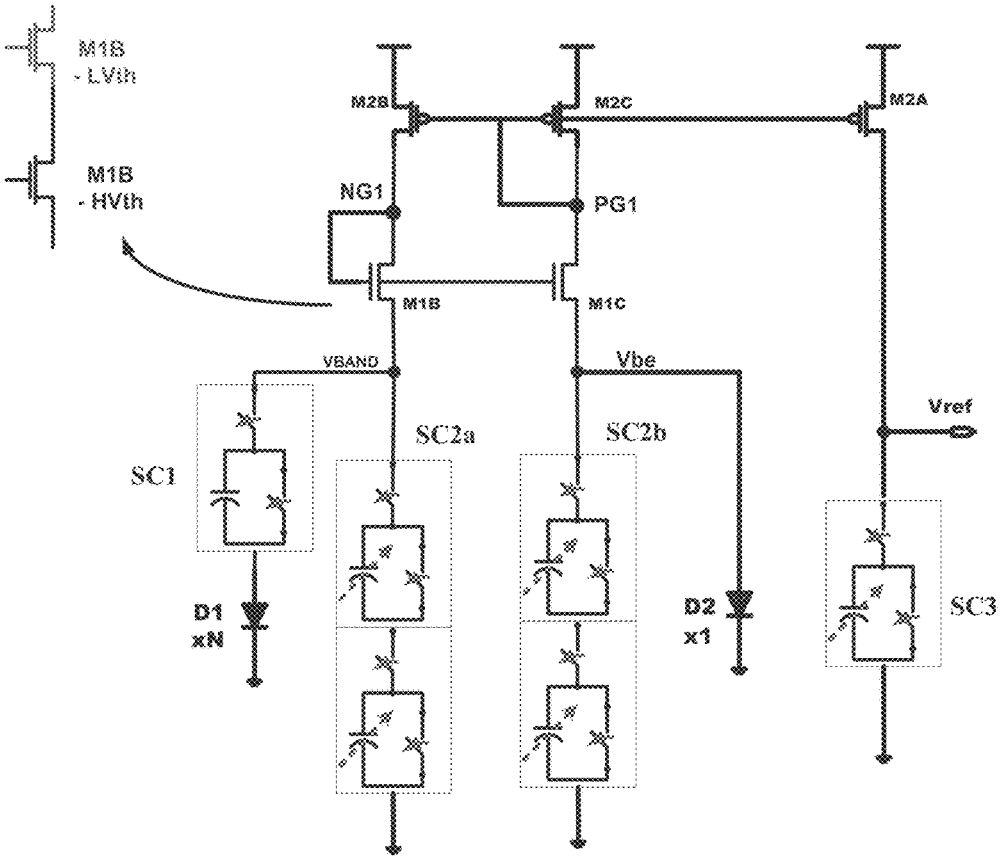
FIG. 6 is a simplified circuit diagram of a BGREF circuit using switch-cap circuits, in accordance with another non-limiting embodiment of the invention.

Reference is now made to FIG. 6, which is a simplified circuit diagram of a BGREF circuit using switch-cap circuits, in accordance with another non-limiting embodiment of the invention. In this embodiment, the amplifier is replaced by a voltage and current mirror formed by NMOS transistors M1(*b,c*) and M2(*b,c*).

Specifically, the source of an NMOS transistor M1*b* is coupled to node Vband, and its drain and gate are coupled to node NG1. The source of an NMOS transistor M1*c* is coupled to node Vbe, its drain is coupled to node PG1 and its gate is coupled to the gate of M1*b*.

The currents are equal because of the current mirrors M2*b* and M2*c*. The voltages at Vband and Vbe are equal due to the source follower action of M1(*b,c*). In order to improve the gain of the voltage/current mirror circuit, self-biased cascodes may be formed in both M1(*b,c*) and M2(*a,b,c*) as shown in the upper left of FIG. 6 (such as two NMOS transistors M1*b*-LVth and M1*b*-HVth, the drain of M1*b*-HVth being coupled to the source of M1*b*-LVth). This technique exploits the fact that there are multiple Vth's in advanced nodes such that both transistors shown in the upper left of FIG. 6 can be saturated which increases the overall gain of the circuit and hence its accuracy. Since the transistors in the circuit may operate in the deep subthreshold mode, the Vgs voltages can be relatively small and the circuit can operate at 1.1V or even lower. The advantage of the version of FIG. 6 over that of FIG. 4 is that it does not require additional bias currents for the amplifier. However, the version with the amplifier can operate at lower voltages, albeit at slightly higher currents.

The largest flying capacitor of the group may be SC1 since it has the smallest impedance, with a value of ~0.5-1 pF. The capacitance of SC2(*a* or *b*) may be very small, which could result in matching issues. This can be solved by stacking two switch-caps in series and enlarging their size by 233 as shown at SC2*a* and SC2*b* in FIG. 6.

A comparison of the FIG. 6 BGREF to some prior art ultra-low power BJT-based references is shown in Table 1. The BGREF of FIG. 6 has the lowest power and smallest area by a factor of >5 compared to the prior art. The BGREF of FIG. 6 can be placed in high-power mode temporarily to achieve a relatively fast settling time. The BGREF of FIG. 6 exhibits a high degree of configurability, since its output voltage can be adjusted over a wide range by trimming the output switch-cap and also has a temperature coefficient trim capability. The amount of current in the circuit, and hence its wakeup time, can be adjusted by changing the reference frequency of the switch-capacitors.

TABLE 1

| | Invention | Osaki, JSSC 2013 | Lee, ISSCC 2015 | Ji ISSCC 2017 | Shrivastava ISSCC 2015 |
|---|---|---|---|---|---|
| Process | 65 nm | 0.18? m | 0.35? m | 0.18? m | 0.13? m |
| Mechanism | BJT | BJT + MOS | BJT + MOS | BJT + MOS | BJT |
| Temp variation (ppm/C.) | 113 | 114 | 13 | 26 | 75 |
| Untrimmed Accuracy ? (%) | 3 | 1.6 | 0.2 | 0.43 | 0.7 |
| Area (?$m^2$) | <6000 | 25,000 | 480,000 | 55,000 | 26,000 |
| Minimum Vin | 1.2 | 0.7 | 1.4 | >1.3 | 0.5 |
| Vout | 0.67 | 0.55 | 1.2 | 1.24 | 0.5 |
| Output Range | trimmable over 600 mV | single point | single point | single point | single point |
| Temp Coefficient Trim | Yes | No | No | No | No |
| Power (nW) | 2 | 55 | 29 | 9.3 | 32 |
| Settling Time (ms) | 100 u | not reported | not reported | not reported | 5 ms |
| Configurable Power | Yes | No | No | No | No |

The prior art includes:

Y. Osaki, T. Hirose, N. Kuroki and M. Numa, "1.2-V Supply, 100-nW, 1.09-V Bandgap and 0.7-V Supply, 52.5-nW, 0.55-V Subbandgap Reference Circuits for Nanowatt CMOS LSIs," in IEEE Journal of Solid-State Circuits, vol. 48, no. 6, pp. 1530-1538, June 2013

J. M. Lee, et. al. "A 29 nW Bandgap Reference Circuit", IEEE ISSCC Dig. Tech. Papers, pp. 100-101, February 2015

Y. Ji et. al. "A 9.3 nW All-in-One Bandgap Voltage and Current Reference Circuit", IEEE ISSCC Dig. Tech. Papers, pp. 100-101, February 2017

A. Shrivastava, K. Craig, N. E. Roberts, D. D. Wenzloff, and B. H. Calhoun, "A 32 nW Bandgap Reference Voltage Operational from 0.5V Supply for Ultra-Low Power Systems" IEEE ISSCC Dig. Tech. Papers, pp. 94-95, February 2015

Preliminary Results

Figure 7A:
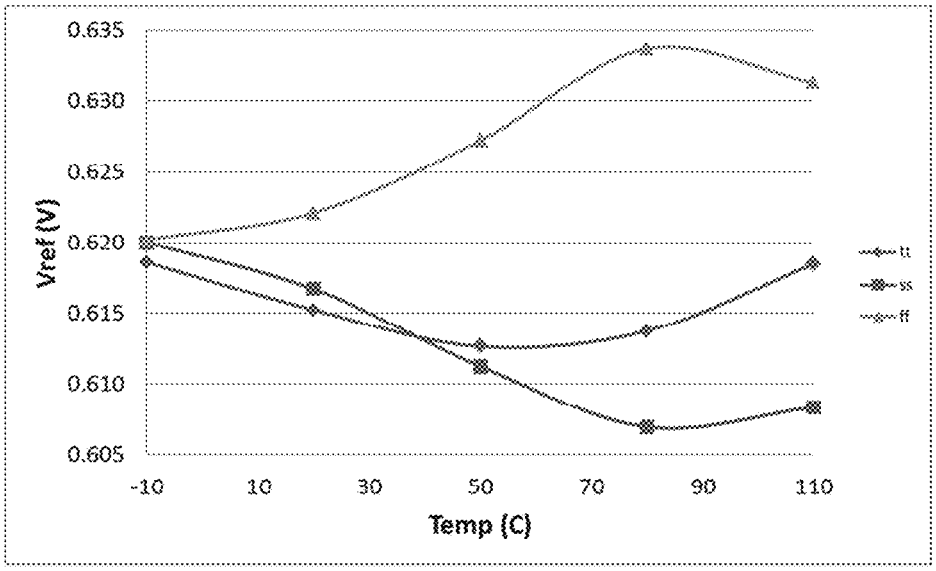
Figure 7B:
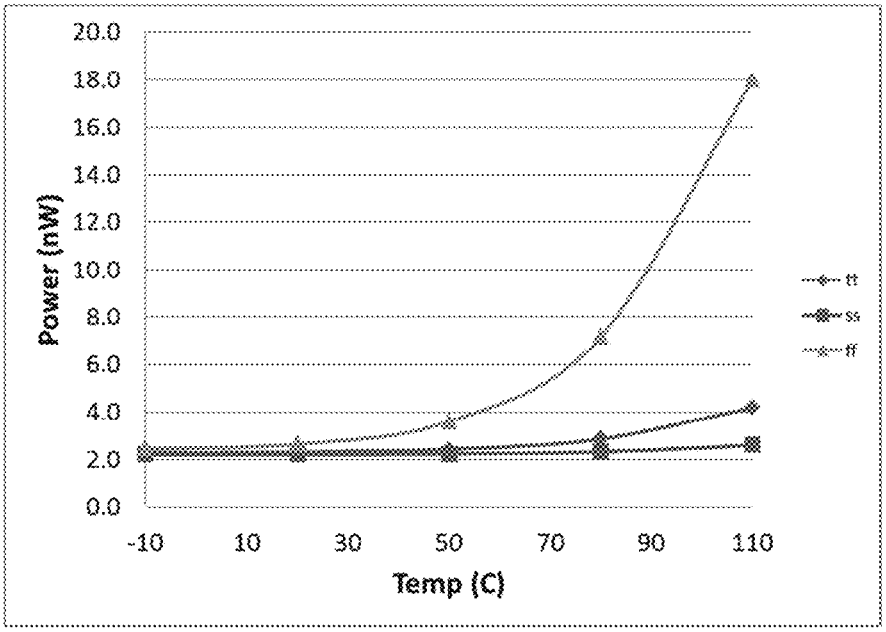
Figure 7C:
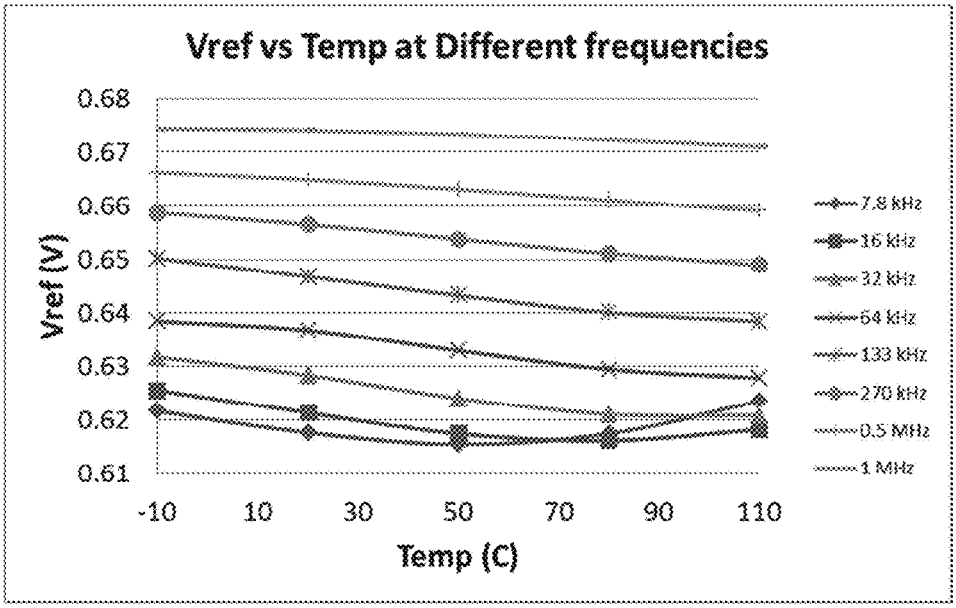
Figure 7D:
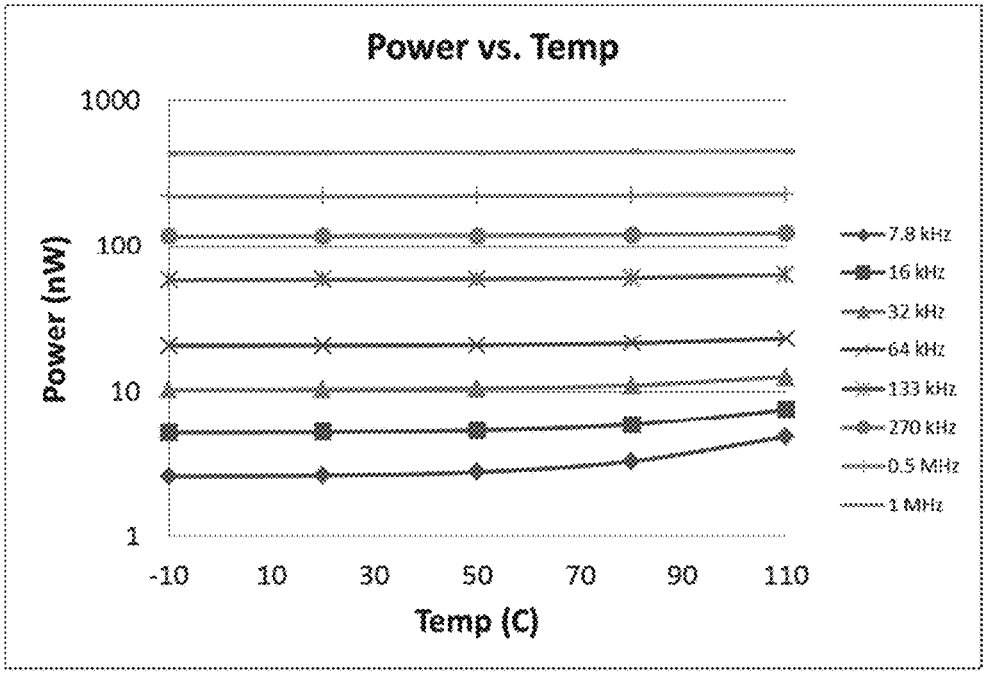

Simulations of the FIG. 6 version of the BGREF are shown in FIGS. 7A-7D for VCC=1.2V. FIG. 7A shows a low power mode in several corners, while FIG. 7B shows the power consumption at these corners. The power consumption at room temperature is 2 nW in all of these corners. In the fast corner (ff), the power rises at high temperature, presumably due to leakage. The ff corner also exhibits a more positive temperature coefficient, which may also be associated with leakage currents. The Vref voltage is shown at different switching frequencies in FIG. 7C, while the power consumption at these frequencies is shown in FIG. 7D for the typical corner. FIG. 7C shows that at very low power modes, the temperature coefficient of the BGREF is affected, presumably due to the PTAT constant term. This can be corrected using the temperature coefficient trim or by other methods. Also note that at the frequency rises, so does the Vref value. This is because Vbe has some dependency on current. This can be calibrated using the voltage trimming between different modes. The output ripple at all frequencies is 8 mV.

What is claimed is:

1. A circuit comprising:

a bandgap reference (BGREF) circuit that comprises at least one switch capacitor impedance element comprising a capacitor coupled with switches that receive a reference frequency, said at least one switch capacitor element coupled with at least one diode, wherein said at least one switch capacitor element and said at least one diode combine to generate a temperature independent BGREF voltage.

2. The circuit according to claim 1, wherein said reference frequency is modifiable to change an impedance of said at least one switched capacitor impedance element such that current in said BGREF circuit is controlled by modification of said reference frequency.

3. The circuit according to claim 1, wherein said at least one switch capacitor impedance element is coupled to a feedback circuit.

4. The circuit according to claim 1, wherein said feedback circuit comprises an amplifier coupled to said at least one diode.

5. The circuit according to claim 1, wherein said at least one diode comprises a first diode and a second diode, wherein a current density of said second diode is a multiple of a current density of said first diode.

6. The circuit according to claim 5, wherein an anode of said first diode is connected to said at least one switched-capacitor impedance element and a cathode of said first diode is connected to a negative voltage supply, and a cathode of said second diode is connected to the negative voltage supply.

7. The circuit according to claim 1, wherein the BGREF circuit comprises at least three switch capacitor impedance elements, and said at least one diode comprises two diodes, one of the diodes being a multiple of the other diode, and the voltage reference is expressed as:

$$V_{ref} = \frac{1}{SC3}[V_T * SC_1 \ln(N) + SC_2 * Vbe] \tag{4}$$

wherein $V_T$ = voltage at a certin absolute temperature $T$ $N$ = ratio between the two diodes $SC_i$ = capacitance of the ith switch capacitor impedance element $Vbe$ = base-emitter voltage and current in an output stage is expressed as $$I_{ref} = V_{ref} * sSC3 = s[V_T * SC_1 \ln(N) + SC_2 * Vbe].$$

wherein $V_T$=voltage at a certain absolute temperature T

N=ratio between the two diodes $SC_i$=capacitance of the ith switch capacitor impedance element Vbe=base-emitter voltage and current in an output stage is expressed as $$I_{ref}=V_{ref}*sSC3=s[V_T*SC_1 \ln(N)+SC_2*\text{Vbe}] \quad (4).$$

8. The circuit according to claim 1, wherein said at least one switched capacitor impedance element comprises a capacitor bank containing parallel connections of capacitors connected in series with switches.

9. The circuit according to claim 1, wherein said feedback circuit comprises current mirrors or voltage-and-current mirrors.

10. The circuit according to claim 9, wherein said feedback circuit comprises MOS devices that include self-biased cascodes.

11. The circuit according to claim 1, wherein said BGREF circuit comprises components wherein:

a source of a PMOS transistor (M2B) is coupled to a voltage source (Vcc), a drain of said transistor (M2B) is coupled to a node (Vband) and a gate of said transistor (M2B) is coupled to a node (PG1);

the node (PG1) is coupled to a feedback circuit element;

a source of a PMOS transistor (M2C) is coupled to a voltage source (Vcc), a drain of said transistor (M2C) is coupled to a node (Vbe) and a gate of said transistor (M2C) is coupled to the node (PG1);

a switch capacitor element (SC1) is coupled at a first terminal thereof to said node (Vband) and at a second terminal thereof to a first terminal of a diode (D1);

a second terminal of said diode (D1) is coupled to a negative voltage supply (Vss);

a switch capacitor element (SC2*a*) is coupled at a first terminal thereof to said node (Vband) and at a second terminal thereof to a negative voltage supply (Vss);

a switch capacitor element (SC2*b*) is coupled at a first terminal thereof to said node (Vbe) and at a second terminal thereof to the negative voltage supply (Vss);

a first terminal of a diode (D2) is coupled to said node (Vbe) and a second terminal thereof is coupled to the negative voltage supply (Vss);

a source of a PMOS transistor (M2A) is coupled to a voltage source (Vcc), a drain of said transistor (M2A) is coupled to a node (Vref) and a gate of said transistor (M2A) is coupled to the gate of said transistor (M2C); and a switch capacitor element (SC3) is coupled at a first terminal thereof to said node (Vref) and at a second terminal thereof to the negative voltage supply (Vss).

12. The circuit according to claim 11, wherein said feedback circuit element comprises an output of an amplifier (A1), with a first input coupled to said node (Vband) and a second input coupled to said node (Vbe), and whose output is coupled to said node (PG1).

13. The circuit according to claim 11, wherein said feedback circuit element comprises a voltage and current mirror formed by NMOS transistors (M1(*b,c*)) and (M2(*b, c*)), wherein a source of the NMOS transistor (M1*b*) is coupled to the node (Vband), and its drain and gate are coupled to a node (NG1), and a source of the NMOS transistor (M1*c*) is coupled to the node (Vbe), its drain is coupled to the node (PG1) and its gate is coupled to the gate of said transistor (M1*b*).

14. The circuit according to claim 8, wherein said capacitor bank comprises circuit elements coupled in parallel.

15. The circuit according to claim 1, wherein said at least one switched capacitor impedance element comprises a first switched capacitor impedance element and wherein said at least one diode comprises a first diode connected to a node (1) and a second diode connected to a first node of said first switch-capacitor impedance element, whose second node is connected to a node (2), and a feedback circuit is placed such that a current density of the first diode is a multiple of the current density of the second diode and the voltages at said node (1) and said node (2) are equal.

16. The circuit according to claim 15, wherein the first and second diodes are PN junction diodes and the anode (P) of the first diode is connected to said node (1) while the cathode (N) of the first diode is connected to a negative voltage supply (Vss), while the anode (P) of the second diode is connected to the first node of the first switched-capacitor impedance element while the cathode (N) of the second diode is connected to the negative voltage supply (Vss).

17. The circuit according to claim 16 wherein said at least one switched capacitor impedance element further comprises a second switched-capacitor impedance element connected between said node (1) and said negative voltage supply (Vss) and a third switched capacitor impedance element connected between said node (2) and said negative voltage supply (Vss).

18. The circuit according to claim 15, wherein said at least one switched capacitor impedance element further comprises a second switched-capacitor impedance element connected between said node (1) and a first supply voltage and a third switched-capacitor impedance element connected between said node (2) and the first supply voltage.

* * * * *